US005649575A

United States Patent [19]

Till

[11] Patent Number: 5,649,575

[45] Date of Patent: Jul. 22, 1997

[54] KEG FILLING PROCESS AND APPARATUS

[75] Inventor: Volker Till, Hofheim am Taunus, Germany

[73] Assignee: GEA Till GmbH & Co., Kriftel, Germany

[21] Appl. No.: 404,967

[22] Filed: Mar. 16, 1995

[30] Foreign Application Priority Data

Mar. 17, 1994 [DE] Germany ..... 44 09 135.4

[51] Int. Cl.[6] ..... B67C 3/34; B67C 3/22; B65B 55/10

[52] U.S. Cl. ..... 141/90; 141/1; 141/92; 141/94; 141/113

[58] Field of Search ..... 141/90–92, 1, 141/48, 63, 89, 94, 113

[56] References Cited

U.S. PATENT DOCUMENTS

| | | | |
|---|---|---|---|
| 2,787,875 | 4/1957 | Johnson . | |
| 3,166,106 | 1/1965 | Reeves et al. | 141/91 |
| 3,615,823 | 10/1971 | Tuma et al. | 141/91 X |
| 3,648,742 | 3/1972 | Beech | 141/92 |
| 3,765,142 | 10/1973 | Lindquist et al. | 141/91 X |
| 4,353,398 | 10/1982 | Weiler et al. | 141/91 |
| 4,527,377 | 7/1985 | Hayashi et al. | 141/90 X |
| 4,623,516 | 11/1986 | Weiler et al. | 141/91 X |
| 4,989,649 | 2/1991 | Weiler et al. | 141/1 |

FOREIGN PATENT DOCUMENTS

| | | |
|---|---|---|
| 0 317 908 A1 | 11/1988 | European Pat. Off. . |
| 0 405 279 A1 | 6/1990 | European Pat. Off. . |
| 1432408 | 3/1963 | Germany . |
| 42 08 550 A1 | 3/1992 | Germany . |
| 1 138 790 | 4/1983 | United Kingdom . |

*Primary Examiner*—J. Casimer Jacyna
*Attorney, Agent, or Firm*—Chilton, Alix & Van Kirk

[57] ABSTRACT

In the filling of a keg with a beverage via a filling head, the filling head is sterilized immediately prior to initiating the flow of the beverage into the keg via the head and a fitting on the keg. Complete sterilization is achieved by ensuring that the temperature of the normally coldest portion of the filling head will be raised to a sufficiently high level and maintained at least at this level until a predetermined number of Pasteur units has been reached.

20 Claims, 1 Drawing Sheet

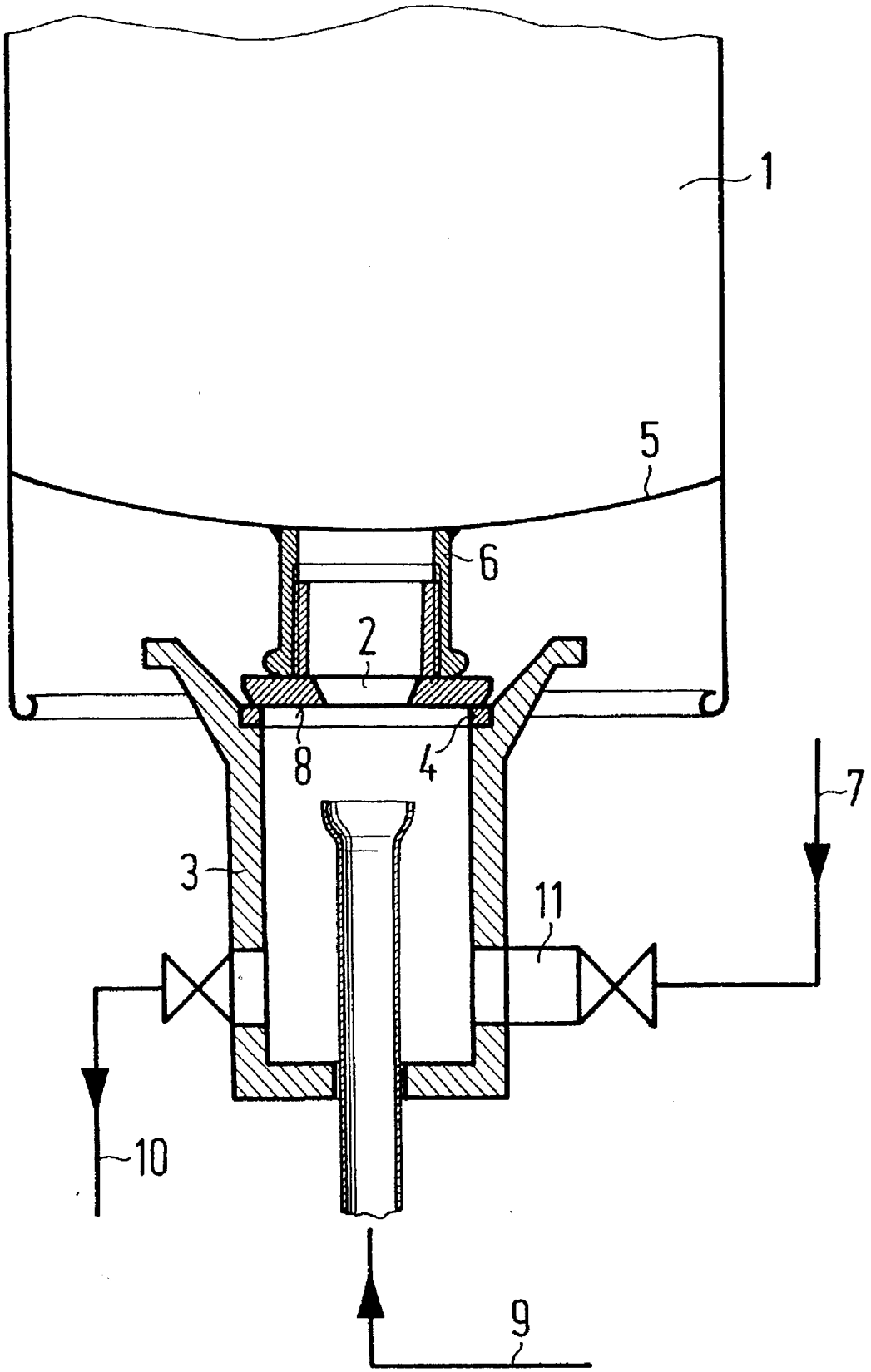
1
5
6
2
8
4
7
3
11
10
9

KEG FILLING PROCESS AND APPARATUS

BACKGROUND OF THE INVENTION

1. Field of the Invention

The present invention relates to the dispensing of beverages and, particularly, to the filling of barrels, and particularly kegs, in which beverages are transported from a brewer or the like to a consumer. This invention is also directed to apparatus for use in the refilling of kegs subsequent to sterilization and, especially, to a filling head which ensures against contamination of the keg during the filling process. Accordingly, the general objects of the present invention are to provide novel and improved methods and apparatus of such character.

2. Description of the Prior Art

In the beverage industry, barrels having integral automatic shut-off valves, through which the barrel is filled and subsequently drained, are commonly employed to transfer a beverage in bulk from the manufacturer to a consumer location. Such barrels are referred to in the industry as kegs and the self-closing valves employed therein are known as fittings. The kegs are returnable containers which, because of the requirement for a high degree of cleanliness dictated by the fact that food products are shipped therein, are sterilized after each use. Such sterilization is accomplished using steam and/or another appropriate sterilizing medium. After cleaning, which is usually performed on a cleaning head in the filling plant, the keg will be positioned on a filling head which is connected to a product feed. The filling head and the external surfaces of the keg fitting are exposed to the ambient air before the keg is positioned on the filling head. It is common practice, before filling begins, for the feed conduit and the filling head to be rinsed with water for a short period of time for the purpose of removing air in the conduit and the head. Such rinsing is performed primarily to prevent oxygen, which could cause degradation of the product, from remaining in the feed lines and head and thus being injected into the keg. It is also known to remove air from the feed conduit through the use of pulses of steam.

Beverages are generally bottled at cold temperatures. For example, beer is usually bottled at temperatures in the range of −2° to +4° C. Nonalcholic drinks will typically be bottled at temperatures in the range of 6°–8° C. The feed conduit between the beverage source and the filling head, and thus the metal surfaces of the filling head, are accordingly cooled by conduction and are cold when the keg is placed on the head and while a sterilized keg is being filled. The above-described techniques for minimizing the possibility of oxygen flowing into a keg during filling, while removing air from the system, do not eliminate or kill bacteria on the cold surfaces of the filling head. Thus, when the integral fitting is opened and the keg filled, germs from the filling head can be rinsed from the head into the keg thereby compromising the previously achieved sterile environment.

SUMMARY OF THE INVENTION

The present invention overcomes the above-briefly discussed and other deficiencies and disadvantages of the prior art by providing a novel and improved process for the filling of kegs with beverages and, particularly, a technique which minimizes the possibility of contaminents being transferred from a filling head to the interior of a keg during the filling thereof. The invention also encompasses a novel and improved filling head for use in the practice of this method.

In accordance with the present invention, the filling head and the outside surfaces of the keg fitting which are in communication therewith are sterilized before the fitting is opened and the beverage allowed to flow into the keg. Thus, the invention ensures that all of the surfaces of the filling station that come into contact with the product are basically germ-free so that, when a sterilized keg is opened for filling, no impurities will flow into the keg with the beverage.

Sterilization of the surfaces of the filling head and keg fitting in accordance with the present invention is accomplished with steam or some other appropriate disinfectant which is compatible with the use to be made of the keg.

In the practice of the present invention, in order to ensure sterilility, the filling head will be subjected to the sterilizing agent for a finite time which is a function of temperature. Thus, for example, at a sterilization temperature of 63° C., the metal surfaces of the filling head must be exposed to that temperature for approximately fifteen minutes. At a sterilization temperature of 72° C., the sterilization time will be approximately thirty seconds. The present invention, therefore, provides for the temperature of the filling head and the sterilization time to be monitored during the sterilization cycle.

The ratio of sterilization temperature to time is conventionally measured in Pasteur units. Thus, in the practice of the present invention, the monitored temperature of the filling head and the sterilization time will preferably be converted into Pasteur units and the sterilization cycle will be terminated when a predetermined number of Pasteur units is reached. By controlling the filling system in this manner, it can be guaranteed that the filling head is sufficiently sterilized and the hot steam or other disinfectent not admitted to the head for an excessive period.

As an optional, and customarily performed, further step in the practice of the invention, the filling head is rinsed with water prior to sterlization. It is possible, because of the temperatures which the metal surfaces of the filling head reach during sterilization, that product residues from the previous filling cycle can be "burnt" onto these surfaces. The water rinse will remove any product residues which may be adhering to the metal surfaces of the filling head before the hot sterilizing agent is admitted.

A filling head in accordance with the present invention includes a temperature sensor whereby the sterilization temperature can be accurately monitored. This temperature sensor is advantageously positioned so as to measure that region of the filling head that can be expected to experience the lowest temperature. Accordingly, if the region where the temperature is sensed is exposed to the requisite sterilization temperature for a sufficiently long period of time, it can be assumed that all of surface areas of the filling head exposed to the sterilizing agent have also been successfully sterilized.

Since the filling head is coupled to the refrigerated source of the beverage with which the keg is to be filled, as a result of the thermal conductivity of the components of the system, the coldest place on the filling head is generally in the region of the product feed. Thus, in a preferred embodiment, the temperature sensor is located so as to measure the temperature where the product feed conduit is connected to the filling head.

BRIEF DESCRIPTION OF THE DRAWING

The present invention may be better understood, and its numerous objects and advantages will become apparent to those skilled in the art, by reference to the accompanying drawing which is a schematic, side-elevation view, partly in section, of a filling head in accordance with the present invention with a keg to be filled positioned thereon.

DESCRIPTION OF THE DISCLOSED EMBODIMENT

With reference now to the drawing, a sterilized keg which is to be refilled with a beverage is indicated at 1, the keg 1 being only partly and schematically shown. Keg 1 has an integral bushing 6 in the base 5 thereof. A fitting 2, which contains the automatic shut-off valve through which the keg is filled and the beverage subsequently dispensed, is screwed into the bushing 6. When keg 1 is to be filled, it is placed in an inverted condition, as shown in the drawing, on the filling head 3 and a seal is established between a sealing ring 4 on head 3 and an outside flange portion 8 of fitting 2. Since the keg and its fitting are conventional, they have not been shown in detail and the manner in which the shut-off valve in fitting 2 is opened and closed will not be described herein.

Prior to being positioned on filling head 3, the keg 1 was cleaned and/or sterilized. However, the outer surfaces of fitting 2 which are in communication of head 3, as well as the interior surfaces of head 3 itself, are in contact with the ambient air before the keg is positioned on the filling head. Accordingly, contaminents such as bacteria can accumulate on the surfaces of filling head 3 and on the outside of fitting 2.

Before keg 1 is filled with the liquid product, which is fed to filling head 3 via a product feed conduit 7, the filling head 3 is rinsed briefly, preferably with warm water, which is delivered via a conduit 9 into the filling head 3. This rinse cycle will remove any product residues that may have adhered to the inside surfaces of the filling head during a previous keg filling cycle. The rinse water will flow out of filling head 3 via an outlet port and discharge conduit 10 after a rinse cycle that, for example, will be of two seconds duration.

Subsequent to the above-described rinse cycle, if performed, the filling head 3 and the outside surfaces of the keg fitting 2 which are in communication therewith are sterilized by exposure to hot steam or an appropriate disinfectant. The sterilizing fluid is also delivered to the interior of filling head 3 via conduit 9. In order to obtain the requisite degree of cleanliness, sterilization must raise the temperature of the metal comprising the filling head to at least 63° C. This temperature must be maintained for at least fifteen minutes with the requisite duration of the sterilization cycle decreasing as the temperature is increased. Thus, at a metal temperature of 72° C., a sterilization cycle duration of thirty seconds is adequate. The present invention contemplates measurement of both temperature and time for the purpose of exercising control over the sterilization cycle.

As discussed above, the preferred mode of practice of the invention comprises measuring the temperature of that portion of filling head 3 which will be at the lowest temperature. Where the keg 1 is to be filled with a refrigerated liquid, the lowest temperature portion of head 3 can be expected to be at the port where the product feed conduit 7 is connected to head 3. Thus, in accordance with the disclosed embodiment of the invention, a termperature sensor 11 is provided for measuring the temperature of head 3 in the vicinity of the product feed connection.

The ratio between sterilization temperature and time is usually specified in Pasteur units. The number of Pasteur units active at the area where the temperature is monitored can thus be calculated from the information provided by temperature sensor 11 and the measured time at temperature. This calculation may then employed for exercising control over the filling system whereby, as soon as a predetermined number of Pasteur units corresponding to sufficient sterilization is reached, the sterilization cycle can be ended. This guarantees that the filling head 3 is not exposed to the hot steam or other sterilization agent for an unnecessarily long period of time.

While a preferred embodiment has been shown and described, various modifications and substitutions may be made thereto without departing from the spirit and scope of the invention. For example, the invention may be practiced manually but also encompasses the electronic monitoring of the temperature information provided by sensor 11 and time for the purpose of automatically controlling the sterilization of filling head 3. Thus, it is to be understood that the present invention has been described by way of illustration and not limitation.

What is claimed is:

1. In a process for filling a reusable container with a beverage, the container having been previously sterilized and being provided with a fitting which will be engaged by a filling head having an interior chamber, the fitting having external surfaces and including a normally closed valve through which the container is filled, the improvement comprising:

simultaneously subjecting the surfaces of the filling head which are to be exposed to the beverage and the external surfaces of the container fitting which are in communication with the interior chamber of the filling head to a sterilizing agent prior to opening the normally closed valve to permit the beverage to fill the container;

measuring the temperature of a portion of the filling head during the time it is subjected to the sterilizing agent;

measuring the period of time the measured temperature is at or above a preselected minimum temperature; and employing the time and temperature measurements to determine the appropriate length of the time the filling head is to be subjected to the sterilizing agent.

2. The process of claim 1 wherein the measured time and temperature are converted into Pasteur units and the sterilization cycle is ended when a predetermined number of Pasteur units has been reached.

3. The process of claim 2 wherein the step of subjecting the filling head to a sterilizing agent comprises delivering steam to the interior of the filling head.

4. The process of claim 2 wherein the step of subjecting the filling head to a sterilizing agent comprises delivering a disinfectant to the interior of the filling head.

5. The process of claim 2 further comprising:

rinsing the interior of the filling head with water prior to the subjection thereof to the sterilizing agent.

6. The process of claim 2 wherein the filling head has an inlet port which is connected to a feed conduit through which the beverage is supplied and wherein the step of measuring temperature comprises:

monitoring the temperature of the area of the filling head adjacent to the connection thereof to the product feed conduit.

7. The process of claim 1 wherein the step of subjecting the filling head to a sterilizing agent comprises delivering steam to the interior of the filling head.

8. The process of claim 7 further comprising:

rinsing the interior of the filling head with water prior to the subjection thereof to the sterilizing agent.

9. The process of claim 7 wherein the filling head has an inlet port which is connected to a feed conduit through which the beverage is supplied and wherein the step of measuring temperature comprises:

monitoring the temperature of the area of the filling head adjacent to the connection thereof to the product feed conduit.

10. The process of claim 9 further comprising:

rinsing the interior of the filling head with water prior to the subjection thereof to the sterilizing agent.

11. The process of claim 10 wherein the measured time and temperature are converted into Pasteur units and the sterilization cycle is ended when a predetermined number of Pasteur units has been reached.

12. The process of claim 1 wherein the step of subjecting the filling head to a sterilizing agent comprises delivering a disinfectant to the interior of the filling head.

13. The process of claim 12 further comprising:

rinsing the interior of the filling head with water prior to the subjection thereof to the sterilizing agent.

14. The process of claim 12 wherein the filling head has an inlet port which is connected to a feed conduit through which the beverage is supplied and wherein the step of measuring temperature comprises:

monitoring the temperature of the area of the filling head adjacent to the connection thereof to the product feed conduit.

15. The process of claim 1 further comprising:

rinsing the interior of the filling head with water prior to the subjection thereof to the sterilizing agent.

16. The process of claim 1 wherein the filling head has an inlet port which is connected to a feed conduit through which the beverage is supplied and wherein the step of measuring temperature comprises:

monitoring the temperature of the area of the filling head adjacent to the connection thereof to the product feed conduit.

17. A filling head for delivering a container-filling beverage to a reusable container, the container being provided with a fitting having an automatic shut-off valve and being sealingly mated with the filling head for filling, said filling head comprising:

a housing, said housing defining an interior chamber which is in communication with a container fitting when a container is mated with the filling head for filling;

product feed means for delivering the container-filling beverage to the interior of said housing;

cleaning means for simultaneously delivering a hot sterilizing agent to said interior chamber of said housing and the surfaces of the container fitting in communication therewith;

means for discharging the sterilizing agent from said interior chamber of said housing; and means for measuring the temperature of at least a portion of said housing during delivery of the sterilizing agent thereto whereby the requisite sterilizing agent delivery time can be determined to thereby ensure that the required degree of sterilization has been achieved.

18. The apparatus of claim 17 wherein said temperature measuring means comprises a temperature sensor positioned to determine the temperature at the normally lowest temperature region of said housing.

19. The apparatus of claim 17 wherein said product feed means comprises:

a product feed conduit and a product feed port in said housing; and wherein said means for delivering sterilizing agent comprises:

a cleaning fluid feed conduit, said cleaning fluid feed conduit discharging into said housing at a point displaced from said product feed port;

and wherein said temperature measuring means comprises:

a temperature sensor positioned to measure the temperature of said housing adjacent to said product feed port.

20. The apparatus of claim 19 wherein the sterilizing agent is steam and wherein said apparatus further comprises:

means for supplying a rinse liquid to said head prior to the delivery of steam, said rinse liquid being supplied through said cleaning fluid feed conduit.

* * * * *